US006223453B1

(12) United States Patent
Matheson et al.

(10) Patent No.: US 6,223,453 B1
(45) Date of Patent: May 1, 2001

(54) ULTRAVIOLET CURING APPARATUS USING AN INERT ATMOSPHERE CHAMBER

(75) Inventors: Derek S. Matheson, Potomac; Andrew G. Moulthrop, Baltimore, both of MD (US)

(73) Assignee: Fusion UV Systems, Inc., Gaithersbug, MD (US)

( * ) Notice: Subject to any disclaimer, the term of this patent is extended or adjusted under 35 U.S.C. 154(b) by 0 days.

(21) Appl. No.: 09/474,079

(22) Filed: Dec. 29, 1999

Related U.S. Application Data

(62) Division of application No. 09/158,603, filed on Sep. 23, 1998.

(60) Provisional application No. 60/099,666, filed on Sep. 9, 1998.

(51) Int. Cl.[7] ..... F26B 3/34

(52) U.S. Cl. ..... 34/276; 34/278

(58) Field of Search ..... 34/255, 258, 259, 34/264, 265, 267, 273, 275, 276, 278

(56) References Cited

U.S. PATENT DOCUMENTS

| | | | |
|---|---|---|---|
| 3,059,861 | 10/1962 | Umbricht et al. . | |
| 3,654,459 | 4/1972 | Coleman . | |
| 3,790,801 | 2/1974 | Coleman . | |
| 4,143,468 | 3/1979 | Novotny et al. . | |
| 5,092,264 | 3/1992 | Overton et al. . | |
| 5,094,010 | 3/1992 | Jacobi et al. . | |
| 5,097,136 | 3/1992 | Meyer et al. . | |
| 5,476,634 | 12/1995 | Bridges et al. . | |
| 5,514,215 | 5/1996 | Takamatsu et al. . | |
| 5,644,135 | 7/1997 | Matheson et al. . | |
| 5,655,312 | 8/1997 | Sevcik . | |
| 5,669,974 | 9/1997 | Cueller et al. . | |
| 5,720,814 | 2/1998 | Takagi et al. . | |
| 5,779,816 | 7/1998 | Trinh . | |
| 5,904,773 * | 5/1999 | Himes | 118/314 |

* cited by examiner

*Primary Examiner*—William Doerrler
*Assistant Examiner*—Malik N. Drake
(74) *Attorney, Agent, or Firm*—Shlesinger, Arkwright & Garvey LLP

(57) ABSTRACT

A curing apparatus comprises a curing chamber for accommodating a controlled atmosphere for a product being treated and an irradiator for providing radiation directed at the product. The curing chamber has spaced inlet and outlet openings for the product establishing a path of travel underneath the irradiator. First and second nozzle assemblies are disposed adjacent respective inlet and outlet openings for supplying inert gas into the chamber and maintaining an inert atmosphere within the chamber. The nozzle assemblies are removably secured to the chamber. A pre-chamber is provided in the nozzle assemblies to moderate the pressure distribution of the gas within the nozzle assemblies.

11 Claims, 5 Drawing Sheets

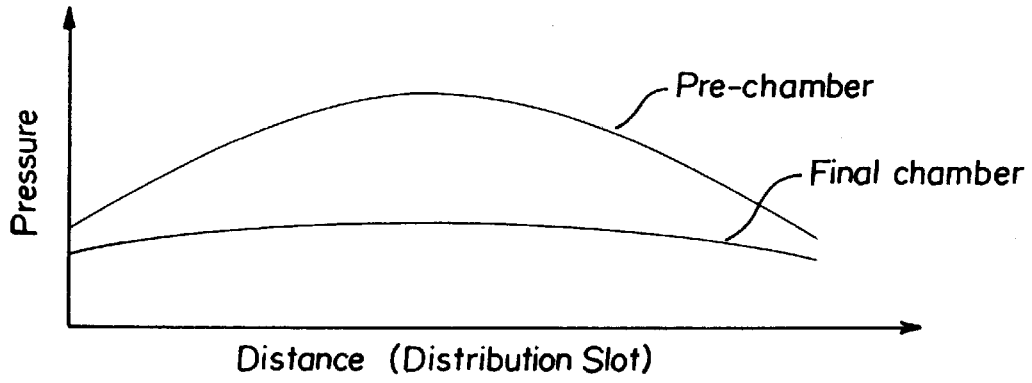
FIG. 9
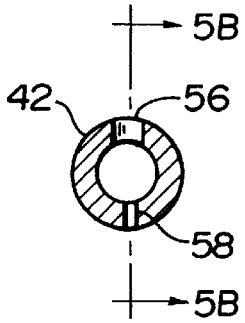
FIG. 5A
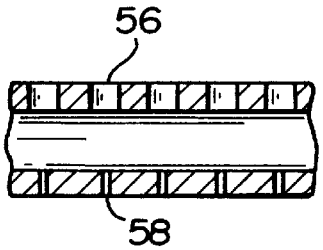
FIG. 5B
FIG. 8
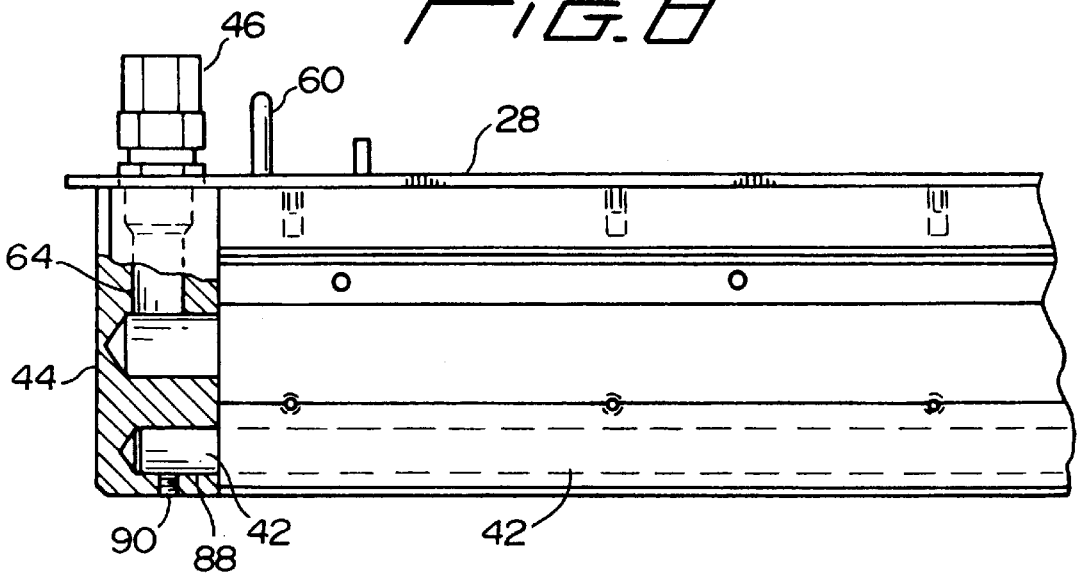

ULTRAVIOLET CURING APPARATUS USING AN INERT ATMOSPHERE CHAMBER

RELATED APPLICATIONS

This application is a division of application Ser. No. 09/158,603, filed on Sep. 23, 1998, which is a nonprovisional application of Ser. No. 60/099,666, filed Sep. 9, 1998.

FIELD OF THE INVENTION

The present is directed to an ultraviolet curing apparatus using an inert atmosphere chamber to exclude the presence or oxygen during the curing process.

The present invention is also directed to a removable nozzle cartridge with adjustable nozzles for delivery of inert gas, such as nitrogen, into a curing chamber.

BACKGROUND OF THE INVENTION

It is well known to apply ultraviolet curable coating to various types of object and to expose the same to ultraviolet radiation to produce a cured coating with desirable properties. For some curing chemistries, the presence of oxygen tends to inhibit the curing process, and so for such chemistries the amount of oxygen must be controlled. A common way of accomplishing this is to provide a curing chamber in which a flow of nitrogen is used to display the oxygen so that an inert atmosphere is provided.

A curing chamber is a relatively large and expensive structure, costing in the order of $150,000. The inert gas is introduced into the chamber by a variety of nozzles which are typically permanently secured to the chamber framework. When an improvement occurs in the nozzle technology, a brand new curing chamber would have to be built to incorporate the improvement, making the existing one obsolete. There is, therefore, a need for a curing chamber where the nozzles are removably secured to the chamber structure so that when improvement occurs in the nozzle technology, the existing chamber can be retrofitted with the new nozzles.

Prior art curing chambers are typically built for specific applications, such as using a specific ultraviolet processor for curing a product traversing through the chamber at a specific speed. If the user desires to increase the curing speed to cure more products per given time, the existing curing chamber may not be adequate, since the nozzles built into the machine may not be adequate to maintain the required inert atmosphere at the higher speed. In this case, the user would either deliver increased amount of nitrogen into the chamber to compensate for the increased speed or invest in a new curing chamber, requiring additional investments and space. Increasing the amount of nitrogen delivered to the curing chamber to accommodate the new application is relatively expensive, since nitrogen is an expensive commodity. There is, therefore, a need for a curing chamber where the nozzles can be changed or adjusted without replacing the entire curing chamber to accommodate the user's new application, without increasing nitrogen consumption or purchasing a new curing chamber.

OBJECTS AND SUMMARY OF THE INVENTION

It is an object of the present invention provide a an inert gas curing chamber where the gas delivery system is removable so that the curing chamber can be used for different product runs.

It is another object of the present invention to provide a gas delivery system to a curing chamber that is in cartridge form so that it can be easily removed or replaced as desired or different applications.

It is still another object of the present invention to provide a gas delivery system for a curing chamber that provides a relatively uniform flow distribution across the path of the product being cured.

It is yet another object of the present invention to provide a gas delivery system for a curing chamber wherein the direction of gas flow coming from the system can be adjusted to accommodate increased product travel speed within the chamber without increasing gas consumption.

It is still further another object of the present invention to provide a gas delivery system for a curing chamber that is removable from the chamber so that adjustments to the system can be made outside of the chamber.

In summary, the present invention provides a curing apparatus comprising a curing chamber for accommodating a controlled atmosphere for a product being treated and an irradiator for providing radiation directed at the product. The curing chamber has spaced inlet and outlet openings for the product establishing a path of travel underneath the irradiator. First and second nozzle assemblies are disposed adjacent respective inlet and outlet openings for supplying inert gas into the chamber and maintaining an inert atmosphere within the chamber. The nozzle assemblies are removably secured to the chamber. A pre-chamber is provided in the nozzle assemblies to moderate the pressure distribution of the gas within the nozzle assemblies.

These and other objects of the present invention will become apparent from the following detailed description.

BRIEF DESCRIPTIONS OF THE DRAWINGS

FIG. 5A is a cross-sectional view taken along line 5A—5A in FIG. 4.

FIG. 5B is a cross-sectional view taken along line 5B—5B of FIG. 5A.

FIG. 8 is a fragmentary view, partly in cross-section, of the nozzle cartridge of FIG. 4, showing details of the endcaps of the pipe nozzle assembly.

FIG. 9 is a schematic illustration of pressure distribution in the pre-chamber and final chamber along the length of the distribution slot of the nozzle cartridge of the present invention.

DETAILED DESCRIPTION OF THE INVENTION

Figure 1:
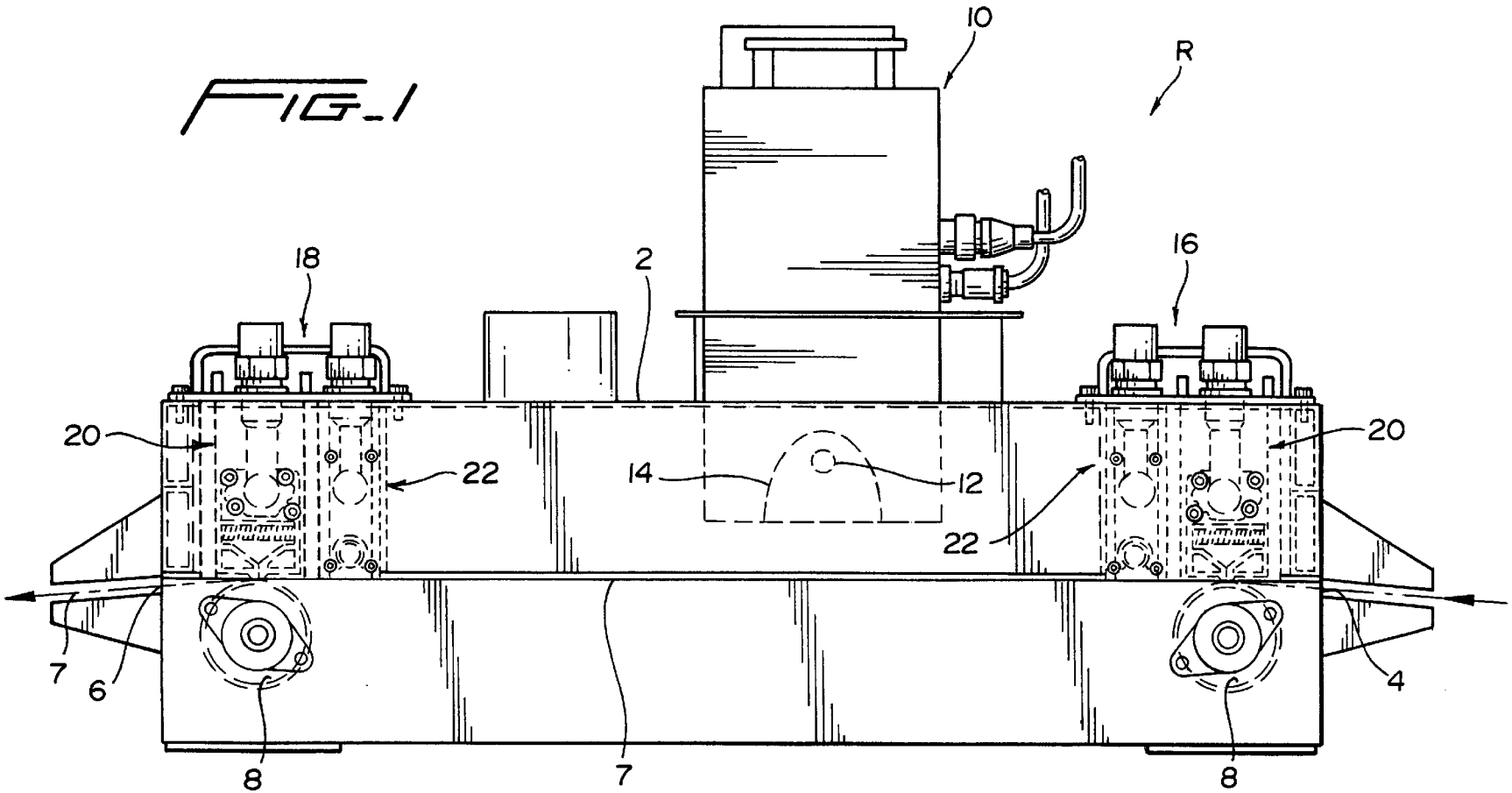
FIG. 1 is a side elevational view of a curing chamber made in accordance with the present invention.

An ultraviolet curing apparatus R made in accordance with the present invention is disclosed in FIG. 1. The apparatus R includes a chamber 2 in which ultraviolet curing of a product is done. The chamber 2 has an inlet opening 4 and an outlet opening 6 through which the product is conveyed into the chamber by means of a web 7. A pair of rollers 8 pull the web 7 through the chamber 2. An irradiator 10, such as a standard ultraviolet lamp, is used to provide the curing process for the product. The irradiator 10 includes a bulb 12 disposed within a reflector cavity 14.

Nozzle cartridges 16 and 18 are disposed within the chamber across the width of the web 7 and adjacent the inlet and outlet openings 4 and 6, respectively, to provide a curtain barrier of an inert gas at the respective openings and to flood the interior of the curing chamber 2 with the same inert gas, preferably nitrogen, to exclude oxygen during the curing process of the product when it is subjected to the ultraviolet radiation of the bulb 12. The nozzle cartridges 16 and 18 are identical to each other, except each is shown turned 180° with respect to the other. Although each of the nozzle cartridges 16 and 18 is disclosed as having a slot nozzle assembly 20 and a pipe nozzle assembly 22, each cartridge may also carry only one nozzle assembly, depending on the specific application.

The slot nozzle assembly 20, which is disposed closer to the respective inlet or outlet opening is used to provide a curtain barrier of inert gas to isolate the interior of the curing chamber 2 from the outside. The pipe nozzle assembly 22 is used to flood the chamber 2 with the inert gas.

Figure 2:
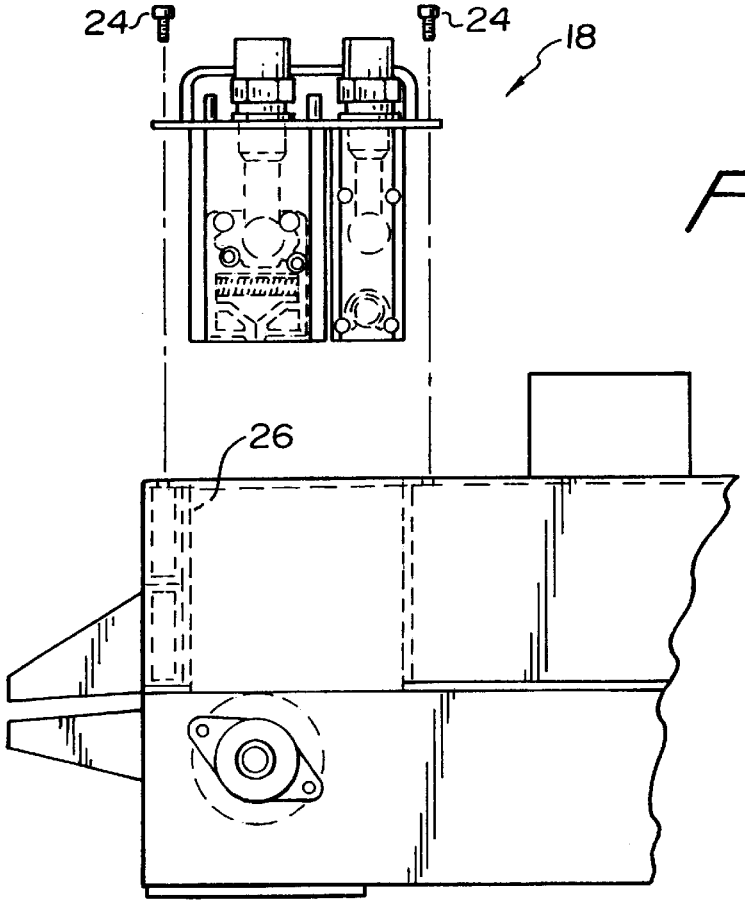
FIG. 2 is a fragmentary view of the curing chamber of FIG. 1, showing a nozzle cartridge being replaced or taken out from the curing chamber.
Figure 3:
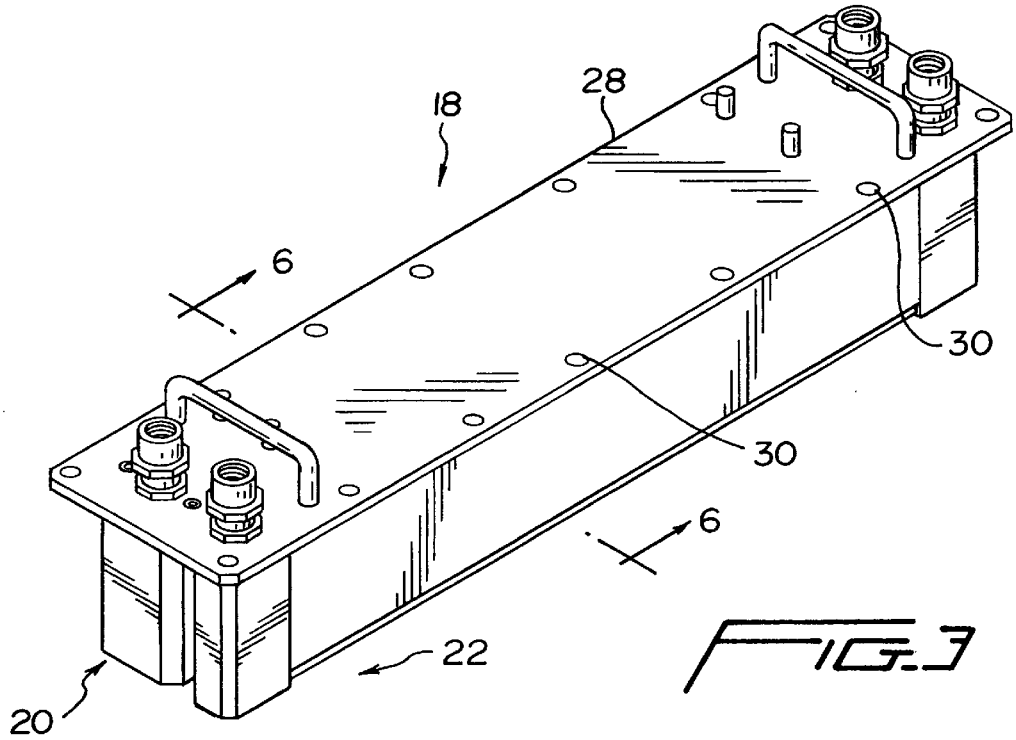
FIG. 3 is a perspective view of the nozzle cartridge shown in FIG. 2.

The nozzle cartridges 16 and 18 are removably secured to the curing chamber 2 by means of screws 24, as best shown in FIG. 2. An opening 26 on top at each end of the curing chamber 2 is adapted to accommodate the nozzle cartridges 16 and 18 into the curing chamber 2. Each of the nozzle cartridges 16 and 18 includes a top plate or support 28 to which the slot nozzle assembly 20 and the pipe nozzle assembly 22 are secured. A plurality of holes 30 around the outer edge of the plate 28 accommodate respective screws 24, which are used to secure the nozzle cartridge in the opening 26 of the curing chamber 2, as best shown in FIG. 3.

The removability of the nozzle cartridges 16 and 18 from the curing chamber 2 advantageously provide the user with flexibility when a change in application of the curing chamber occurs, such as when the web speed is desired to be increased to accommodate a different product, without purchasing another curing chamber. Further, the removability of the cartridges from the curing chamber means that the cartridges can be adjusted on the workbench, which is a much easier operation than if the nozzle assembly is adjusted inside the curing chamber. Also, several previously adjusted cartridges can be stored aside that are then easily installed whenever the need arises for their use on a different application, thereby minimizing downtime in the job.

Figure 4:
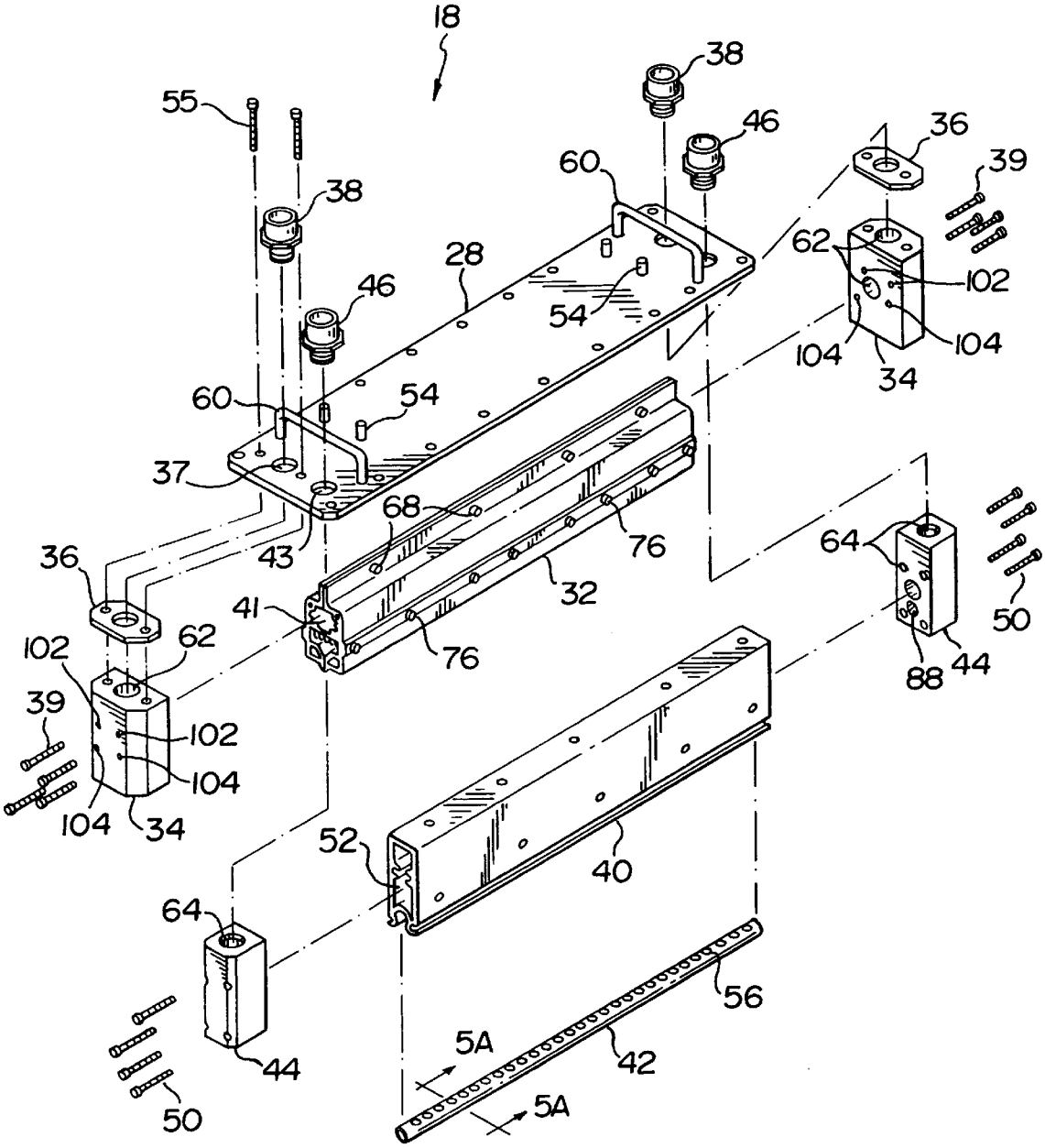
FIG. 4 is a perspective assembly view of the nozzle cartridge of FIG. 3.

The nozzle cartridge 18, which is identical to the cartridge 16 except that they are shown 180° apart, is shown in an assembly view in FIG. 4. The slot nozzle assembly 20 includes a nozzle body 32, endcaps 34, shims 36 and connectors 38. The connectors 38 are threadedly secured to the respective endcaps 34 through respective openings 37 in the plate 28 to thereby secure the endcaps 34 to the plate 28. Screws 39 secure the endcaps 34 to the respective ends of the nozzle body 32 to form an integral pre-chamber 41 within the nozzle body 32. The connectors 38 are used to connect the nozzle assembly to an inert gas supply.

The pipe nozzle assembly 22 includes a nozzle body 40, a pipe diffuser 42, endcaps 44 and connectors 46. Screws 50 secure the endcaps 44 to the sides of the nozzle body 40 to form an enclosed pre-chamber 52. The connectors 46 are threadedly secured to the respective endcaps 44 through respective openings 43 in the plate 28. The connectors 46 are used to connect the nozzle assembly to an inert gas supply.

Studs 54 extending from the top surface of the plate 28 are configured to store unused shims 36. Screws 55 secure the top part of the endcaps 34 to the top plate 28.

The pipe diffuser 42 has a linear array of holes 56 disposed along the length and side of the pipe diffuser 42 facing the nozzle body 40. Another linear array of smaller holes 58 are disposed on the diametrically opposite side of pipe diffuser 42, as best shown in FIGS. 5A and 5B.

A pair of handles 60 disposed at respective end portions of the plate 28 allow the user to conveniently handle the cartridge when removing or replacing it in the curing chamber 2.

Each of the endcaps 34 has an L-shaped passageway 62 to allow the flow of the inert gas from the connector 38 to the pre-chamber 41. Similarly, each of the endcaps 44 also includes an L-shaped passageway 64 to allow the flow of the inert gas from the connectors 46 to the pre-chamber 52.

The slot nozzle body 32 is made from two identical castings 66, which are joined together by a plurality of bolts 68. An interior longitudinal distribution slot 70 is formed between the pair of casting 66 along the length of the pre-chamber 41 in communication therewith. An exit slot 72 is also formed between the two castings 66 at the lower portions thereof to allow the inert gas to flow out into the curing chamber and form a curtain barrier. A final chamber 74 is provided by the castings 66 and is disposed between the slots 70 and 72 and runs along the length thereof. The distribution slot 70 allows the inert gas from the pre-chamber 41 to flow to the final chamber 74.

A plurality of bolts 76 and springs 78 provide a means for adjusting the gap of the exit slot 72 as desired for a specific application. Turning the bolts 76 in either direction will either decrease or increase the gap of the exit slot 72. The springs 78 urge the castings 66 away from each other so that when the bolts 76 are turned counter-clockwise in a conventional unscrewing direction, the castings 66 will move a corresponding distance under the spreading force of the springs 78.

The slot nozzle body 32 is secured to the underside of the plate 28 by means of a bracket 80 and a resilient member 82 that advantageously allows the nozzle body 32 to be angularly adjusted.

The shims 36 are used to adjust the height of the exit slot 72 above the rollers 8, as best shown in FIG. 1.

Figure 6:
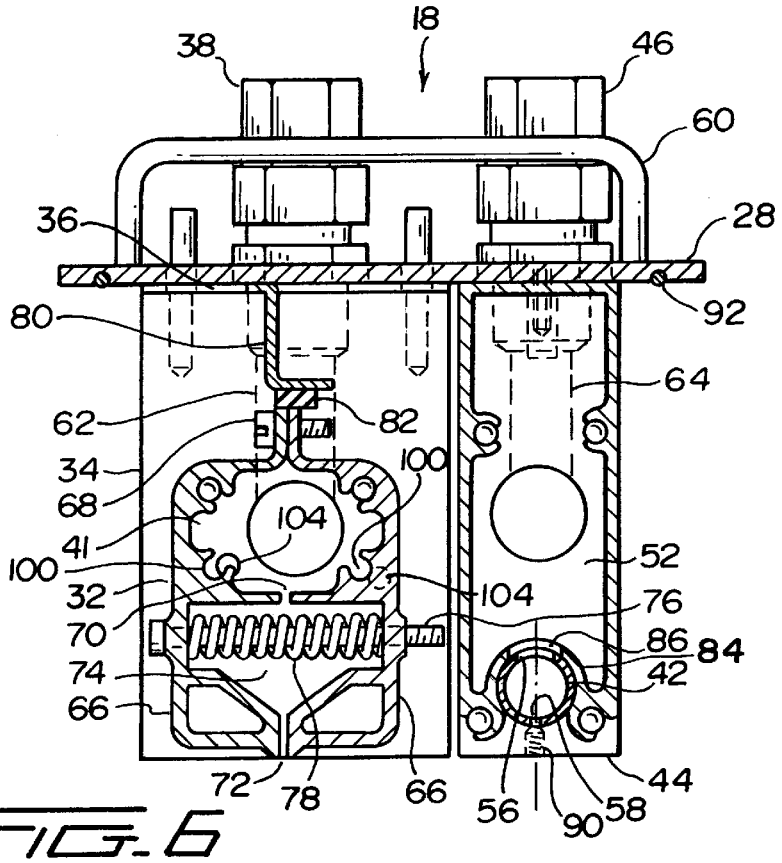
FIG. 6 is a cross-sectional view taken along line 6—6 in FIG. 3.

The nozzle body 40 includes an arcuate wall 84 conformed to the diameter of the pipe diffuser 42, as best shown in FIG. 6. The arcuate wall 84 is used to support the pipe diffuser 42. A longitudinal opening 86 is disposed in a top portion of the arcuate wall 84 and extends along the length of the pipe diffuser 42 to thereby expose the holes 56 to the pre-chamber 52, as best shown in FIG. 6. The end portions of the pipe diffuser 42 are received in respective bore holes 88 and endcaps 44 where set screws 90 permit the pipe diffuser 42 to be angularly adjusted and locked in place (see FIG. 8)

A gasket 92 is disposed around the underside periphery of the plate 28 to provide a seal around the opening 26 when the nozzle assembly is secured in place to the frame of the curing of the curing chamber 2.

Figure 7:
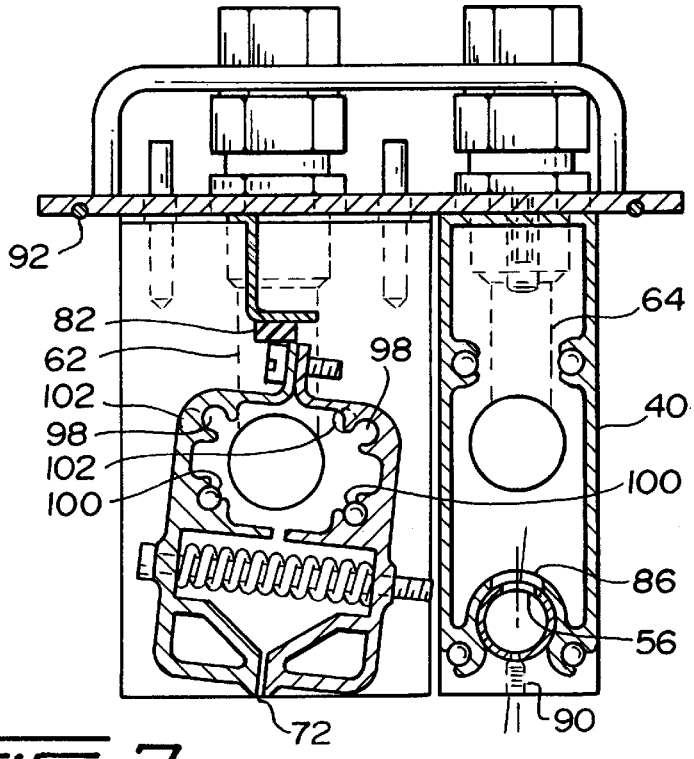
FIG. 7 is similar to FIG. 6, showing the nozzle bodies adjusted to different angular positions from the vertical axis.

The nozzle body 32 includes a plurality of screw-receiving slots 98 and 100, as best shown in FIGS. 6 and 7, that are aligned with respective holes 102 and 104 and are used to provide angular positioning of the nozzle body 32 to change the direction of flow of the inert gas exiting from the exit slot 72. When the holes 102 are used in conjunction with the screw-receiving slots 98 when attaching the nozzle body 32 to the endcaps 34, the exit slots 72 would be directed downwardly at zero degree to the vertical. If the holes 104 are used with the screw-receiving slots 100, the nozzle body 32 and the exit slots 72 would be positioned at an angle from the vertical toward the inlet opening 4 in the case for the cartridge 16.

The range of adjustment for the pipe diffuser 42 is 0°–45° with respect to a vertical axis. The opening 86 in the arcuate wall 84 is configured for the maximum angular adjustment without interfering with the holes 56. The angular positioning of the exit slot 72 and the pipe diffuser 42 will depend on the specific application. Preferably, the slot nozzle 72 for the nozzle cartridge 16 adjacent the inlet opening 4 is preferably directed at an angle toward the inlet opening, while the pipe diffuse 42 would be preferably angled toward the center of the curing chamber 2. The exit nozzle 72 for the nozzle cartridge 18 would be preferably directed perpendicularly toward the web 7, while the pipe diffuser 42 would be preferably directed toward the center of the curing chamber.

The pre-chamber 41 advantageously provides for an even flow of inert gas along the length of the exit slot 72. In the prior art, in order to obtain an even distribution of flow, multiple feeds are provided along the length of the manifold. With the present invention, even distribution of flow is achieved with only two feeds, one at each end of the nozzle body 32 through the connectors 38. The gas flow is substantially made more uniform as it flows from the pre-chamber 41 to the final chamber 74 through the distribution slot 70. The pre-chamber 41 advantageously provides a moderating effect to the pressure distribution within the final chamber 74. This is schematically illustrated in FIG. 9, where a variation of less than 10% along the length of exit slot 72 is achieved with the present invention. In the prior art, about 30% variation in flow rate along the slot length is typical. With the present invention, an inert atmosphere of approximately 50 ppm of oxygen is achieved.

The pre-chamber 52 in the pipe nozzle body 40 also provides for even flow of inert gas along the length of the pipe diffuser 42 as the gas exit through the linear array of exit holes 58. The variation of pressure within the pre-chamber 52 alone the length of the pipe diffuser 42 is also illustrated schematically in FIG. 9, where about 30% variation in the pre-chamber 52 is reduced substantially to about 10% inside the pipe diffuser 42 prior to the gas exiting through the exit holes 58. The pre-chamber 52 advantageously provides a moderating effect to the pressure distribution within the interior of the pipe diffuser 42.

The angular adjustment to the pipe diffuser 42 advantageously permits the curing chamber 2 to accommodate higher web speed. In the prior art, the flow rate of the inerting gas is increased for higher web speed, resulting in higher gas consumption, which in the case of nitrogen could be fairly expensive. With the present invention, adjusting the angle of flow through the pipe diffuser 42 while maintaining the flow rate of the gas feeds through the connectors 46 would still maintain the inerted atmosphere at the higher web speed. At higher web speed, the pipe diffuser 42 would be angled toward the flow of the web at a larger angle from the vertical than at lower web speed. With 15 ppm oxygen of inert gas being introduced to the chamber, 50 ppm oxygen atmosphere can be maintained with the present invention. Maintaining a uniform distribution of inert gas within the chamber, for example at 50 ppm oxygen, is important to the proper curing of the product being cured. If the inert atmosphere varies across the product, then the material properties of the product would vary depending on the variation on the inert atmosphere across the product when it is subjected to the UV radiation.

With the cartridge design of the present invention, the nozzle assemblies 20 and 22 can be pre-adjusted outside the curing chamber for a specific application or job. When a different job is desired to be processed through the chamber, a nozzle assembly which has already been adjusted for that job would be used to replace the one that is in the machine. In this manner, a low level technician can perform the change-over, since no further adjustments to the nozzles would be needed. In the prior art, where adjustments has to be made in the machine, a high level technician or engineer would be required to make the adjustment.

Although the present invention has been described using an ultraviolet irradiator, other types of irradiators, such a thermal heater, would be equally applicable.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A curing apparatus, comprising:

a) a curing chamber for accommodating a controlled atmosphere for a product being treated;

b) an irradiator for providing radiation directed at the product;

c) said curing chamber having spaced inlet and outlet openings for the product establishing a path of travel underneath said irradiator;

d) first and second nozzle assemblies disposed adjacent respective inlet and outlet openings, said nozzle assemblies being adapted to supply inert gas into said chamber and maintain an inert atmosphere therein;

e) said first and second nozzle assemblies being removably secured to said chamber; and f) said chamber including first and second openings adapted to receive said first and second nozzle assemblies, respectively.

2. A curing apparatus as in claim 1, wherein:

a) said first and second nozzle assemblies include a slot nozzle.

3. A curing apparatus as in claim 2, wherein:

a) said slot nozzle is directed substantially transversely to the direction of travel of the product being cured.

4. A curing apparatus as in claim 2, wherein:

a) said slot nozzle disposed adjacent said inlet opening is directed at an angle toward said inlet opening.

5. A curing apparatus as in claim 1, wherein:

a) said first and second nozzle assemblies include a pipe diffuser having first and second linear arrays of holes arranged along its length.

6. A curing apparatus as in claim 1, wherein:

a) said first and second nozzle assemblies include a slot nozzle and a pipe diffuser; and b) said pipe diffuser is disposed inboard of said slot nozzle at said inlet opening.

7. A curing apparatus as in claim 1, wherein:

a) said first and second nozzle assemblies include a slot nozzle and a pipe diffuser; and b) said pipe diffuser is disposed inboard of said slot nozzle at said outlet opening.

8. A curing apparatus as in claim 5, wherein:

a) said pipe diffuser is directed toward the interior of said chamber.

9. A curing apparatus as in claim 5, wherein:

a) said pipe diffuser is directed at approximately 15° toward the interior of said chamber.

10. A curing apparatus as in claim 5, wherein:

a) said pipe diffuser is directed at approximately 45° toward the interior of said curing chamber.

11. A curing apparatus as in claim 1, wherein:

a) said irradiator is a UV lamp.

* * * * *